US007101439B2

(12) United States Patent
Kushihashi et al.

(10) Patent No.: US 7,101,439 B2
(45) Date of Patent: Sep. 5, 2006

(54) FLUID APPLICATION DEVICE

(75) Inventors: Shigenobu Kushihashi, Tokyo (JP); Syozo Horikawa, Tokyo (JP); Junji Ueno, Kohriyama (JP)

(73) Assignee: Japan Tobacco Inc., Tokyo (JP)

( * ) Notice: Subject to any disclaimer, the term of this patent is extended or adjusted under 35 U.S.C. 154(b) by 163 days.

(21) Appl. No.: 10/727,501

(22) Filed: Dec. 5, 2003

(65) Prior Publication Data

US 2004/0124285 A1 Jul. 1, 2004

Related U.S. Application Data

(63) Continuation of application No. PCT/JP02/05707, filed on Jun. 7, 2002.

(30) Foreign Application Priority Data

Jun. 8, 2001 (JP) ..... 2001-174152
Sep. 27, 2001 (JP) ..... 2001-297089

(51) Int. Cl.
*B05B 1/02* (2006.01)
*B05C 11/00* (2006.01)

(52) U.S. Cl. ..... 118/300; 118/692; 118/693; 239/601; 427/286; 427/207.1

(58) Field of Classification Search ..... 118/300, 118/325, 692, 693, 314, 318, 320; 156/578; 239/601, 583, 597–599; 425/425, 568, 562, 425/564; 427/286, 207.1, 356, 359
See application file for complete search history.

(56) References Cited

U.S. PATENT DOCUMENTS 3,348,520 A * 10/1967 Lockwood ..... 118/667
3,684,135 A * 8/1972 Schorr et al. ..... 222/252
3,762,882 A * 10/1973 Grutza ..... 428/615
5,263,608 A * 11/1993 Kiernan et al. ..... 222/1
5,368,237 A 11/1994 Fulkerson
5,999,106 A * 12/1999 Buckler ..... 340/870.09
6,206,963 B1 * 3/2001 Abrahams ..... 118/300
6,826,833 B1 * 12/2004 Maier et al. ..... 29/888.44
6,832,733 B1 * 12/2004 Engel ..... 239/145

FOREIGN PATENT DOCUMENTS

| | | | |
|---|---|---|---|
| EP | 0 594 184 | A1 | 4/1994 |
| EP | 1 002 468 | A2 | 5/2000 |
| JP | 7-68196 | A | 3/1995 |
| JP | 3018447 | U | 9/1995 |
| JP | 10-323607 | A | 12/1998 |
| JP | 11-197572 | A | 7/1999 |
| JP | 2000-254554 | A | 9/2000 |
| JP | 2001-62410 | A | 3/2001 |
| JP | 2001-113219 | A | 4/2001 |

* cited by examiner

*Primary Examiner*—Chris Fiorilla
*Assistant Examiner*—Yewebdar Tadesse
(74) *Attorney, Agent, or Firm*—Birch, Stewart, Kolasch & Birch, LLP

(57) ABSTRACT

A fluid application device stores seam paste in a reservoir tank 18 and feeds the seam paste to a pressure tank 20 through a feed pump 22. Inside of the pressure tank 20 is maintained under a given air pressure by a pneumatic unit 26, and the seam paste is supplied from the pressure tank 20 to an application nozzle 16 through a supply pipe 24. A level sensor 28 detects fluid level of stored seam paste in the pressure tank 20, and a detection signal is input to a controller 30. The controller 30 controls operation of the feed pump 22 based on the detection signal that is transmitted from the level sensor 28 and also controls a supply amount of the seam paste to the pressure tank 20 to maintain the fluid level in the pressure tank 20 at a fixed level.

19 Claims, 3 Drawing Sheets

FLUID APPLICATION DEVICE

This application is a Continuation of copending PCT International Application No. PCT/JP02/05707 filed on Jun. 7, 2002, which designated the United States, and on which priority is claimed under 35 U.S.C. § 120, and this Non-provisional application claims priority under 35 U.S.C. § 119(a) on Patent Application No(s). 2001-174152 and 2001-297089 filed in Japan on Jun. 8, 2001 and Sep. 27, 2001, respectively, the entire contents of which are hereby incorporated by reference.

TECHNICAL FIELD

The present invention relates to a fluid application device discharging fluid from a tip end of a nozzle and continuously applying the fluid to an object that relatively travels with respect to the application device.

BACKGROUND ART

An application device of this kind is used, for example, for continuously applying seam paste to one of side edge portions of wrapping paper when the wrapping paper travels through a rod-forming section of a cigarette manufacturing machine, the side edge portions forming a lap region of the wrapping paper. The wrapping paper as an object herein receives a shredded tobacco layer on an upper surface thereof and travels through the rod-forming section together with a garniture tape. Thereafter, the seam paste as fluid is applied to the wrapping paper as mentioned above, and then the wrapping paper is bent into a cylindrical form to wrap the shred tobacco layer. Thus, the side edge portions of the wrapping paper forming the lap region are adhered to each other, thereby continuously forming a tobacco rod for cigarette rods.

Methods for applying the seam paste to the wrapping paper in the cigarette manufacturing machine include, for example, a method in which the outer circumferential surface of a rotating disc (paste wheel) is brought into contact with the side edge portion of the wrapping paper to transfer the seam paste onto the wrapping paper through the outer circumferential surface of the rotating disc and a method in which the tip end of a nozzle is brought into contact with the side edge portion of the wrapping paper, and the seam paste is discharged from the tip end of the nozzle and applied to the wrapping paper.

In recent years, with the speedup of operation of a cigarette manufacturing machine, the traveling speed of wrapping paper in a tobacco rod-forming process has been increased, and therefore the flow rate of the seam paste to be applied to the wrapping paper has also been increased. In the former method, the flow rate of application of the seam paste is limited by the rotational speed of the disc. Therefore, the latter method using a nozzle is suitable for the cigarette manufacturing machine of high-speed type.

In the case of a conventional application device using the nozzle, the device includes a tank for storing seam paste therein, the seam paste in the tank is supplied to an application nozzle by means of a feeding device such as a gear pump. The feeding device can not only increase the supply rate of the seam paste but also adjust an application amount of the seam paste to a constant value.

Even if the above-mentioned feeding device such as a gear pump allows quantitative supply, however, there occurs minute pulsation in the discharge pressure of the seam paste for a structural factor of the gear pump. Therefore, the supply amount of the seam paste to the application nozzle slightly fluctuates due to the pulsation, resulting in minute fluctuation of the application amount of the seam paste from the application nozzle to the wrapping paper. On the other hand, since the lap region of the wrapping paper is extremely narrow, it is undesirable that the fluctuation, if only minute one, occur in the amount of the seam paste applied to the wrapping paper. This is because if more seam paste than a proper amount is applied, extra seam paste is forced out when the lap region is formed, and on the other hand, if the seam paste is less than the proper amount, there occurs the problem that the side edge portions of the wrapping paper poorly adhere to each other.

Moreover, in the case of the nozzle used in the application device, the flow velocity of seam paste in the nozzle is greatly heightened due to an increase in the flow rate of the seam paste, so that the nozzle receives a quite large fluid friction. For this reason, the fluid friction causes the base material of the nozzle to corrode at the discharge opening of the nozzle, and after the nozzle has been used over a period of long time, the size of the discharge opening is apt to be undesirably enlarged.

Such enlargement of the discharge opening makes the outflow of seam paste unstable, and thus the application amount of the seam paste is caused to change undesirably.

Consequently, one of the issues in the technical field of a fluid application device is to suppress the fluctuation or change of the application amount of fluid in addition to an improvement in application efficiency.

SUMMARY OF THE INVENTION

A fluid application device according to the present invention employs a nozzle. The application device comprises a first and a second tank, feeding means for supplying fluid under pressure from the first tank to the second tank, and a supply path for connecting an application nozzle to the second tank so as to supply the fluid to the application nozzle. In addition, the application device of the present invention further comprises pressurizing means for sealing the inside of the second tank and applying a given air pressure into the sealed second tank, fluid level-detecting means for detecting a fluid level of the stored fluid in the second tank, and maintaining means for controlling the supply of the fluid through the feeding means based on a result of the detection of the fluid level-detecting means and maintaining the fluid level at a fixed height.

According to the aforementioned application device, supply pressure of the fluid to the application nozzle is determined, based on the air pressure applied into the sealed second tank. Therefore, as the inside of the second tank is pressurized and the fluid level of the stored fluid is simultaneously maintained at the fixed height, the supply pressure of the fluid to the application nozzle is stabilized. As a result, it is possible to stabilize the flow rate of the application from the application nozzle to an object. Needless to say, even if the feeding device such as a gear pump is utilized for feeding the fluid from the first tank to the second tank, pulsation in pressure of the fluid delivered from the gear pump does not affect the supply pressure of the fluid to the application nozzle at all.

On the other hand, the inside of the first tank is open to the atmosphere. In this case, whether a cigarette manufacturing machine is in operation or at a standstill, it is possible to replenish the first tank with new fluid. This structure has a beneficial effect especially in a case that the application device is employed for the application of seam paste to the wrapping paper in the cigarette manufacturing machine. This is because the structure in which the first tank can be timely replenished with the seam paste enables supply of the seam paste without stopping the operation of the cigarette manufacturing machine even if consumption of the seam paste is increased with the speedup of operation of the machine.

The application device of the present invention further comprises pressure-detecting means for detecting pressure of the fluid supplied to the application nozzle through the supply path and alarm means for giving a prescribed alarm when the pressure detected by the pressure-detecting means is at a given or higher value. For example, even if the fluid level in the second tank is constant, there is a possibility that the supply pressure of the fluid at an inlet of the application nozzle is abnormally increased due to the clogging of foreign matter (solid matter, impurities, etc.) in the application nozzle. Consequently, it is preferable that an alarm be given to an operator if the pressure of the fluid supplied to the application nozzle reaches a predetermined value or more defined within a generally allowable range.

The pressure-detecting means includes a pressure indicator for indicating a detection value thereof. In this case, the operator can timely check whether the supply pressure of the seam paste is abnormal or not. In this way, if the supply pressure of the fluid is detected to raise an alarm when the detected supply pressure is abnormal, and the value thereof is indicated, it is possible to find early the clogging in the application nozzle and remove the causes thereof.

In a case that the application device of the present invention is employed to apply the seam paste to the wrapping paper in the cigarette manufacturing machine, the application nozzle is located in a rod-forming section of the cigarette manufacturing machine. The seam paste is applied to one of side edge portions of the wrapping paper for forming a lap region thereof when the wrapping paper travels through the rod-forming section together with garniture tape. In this case, the application device of the present invention further comprises a needle valve capable of opening/closing a discharge opening of the application nozzle and opening/closing means for opening/closing the needle valve according to an operation state of the cigarette manufacturing machine.

According to the above structure, the cigarette manufacturing machine starts to operate and the wrapping paper is supplied, and then the needle valve is opened when conditions for accepting the application of the seam paste are fulfilled, which makes it possible to immediately apply the seam paste to the wrapping paper. On the other hand, for example, if there occurs accidental abeyance of operation of the cigarette manufacturing machine or the like, and therefore it is considered that the seam paste should not be applied, the needle valve can be immediately closed.

The application nozzle includes a main body having a tip end directed to face an object, a discharge opening formed at the tip end of the main body, for discharging the fluid to be applied to the object, a contact surface formed on the tip end of the main body, the contact surface spreading around circumference of the discharge opening and being brought into contact with a side edge portion of the object, a discharge hole extending from the discharge opening toward the inside of the main body and guiding the discharge of the seam paste from the inside of the main body, a corner face formed along the circumference of the discharge opening and chamfering a boundary between an inner wall of the discharge hole and the contact surface into a curved surface, and a coating layer formed on a surface of the main body and covering an area extending from the contact surface including the corner face to the inner wall of the discharge hole.

According to the above-mentioned structure, when the fluid is discharged from the discharge opening of the application nozzle, the coating layer bears discharge friction, so that a material of the application nozzle is protected by the coating layer. The corner face allows the coating layer to smoothly extend from the contact surface to the inner wall of the discharge hole and ensures the protection of the material by the coating layer. Moreover, there is no edge formed along the circumference of the discharge opening, thereby resolving conventionally seen enlargement of the discharge opening, that is caused by corrosion of the edge thereof.

Furthermore, the application device provides an independent invention of which the subject matter includes technical characteristics in the shape of the application nozzle and a surface finishing thereof. In this case, the application device of the present invention comprises an application nozzle located so as to face an object that relatively travels with respect to the object and having a discharge opening formed a tip end thereof, for discharging fluid to continuously apply the fluid to the object, a contact surface formed on the tip end of the application nozzle, the contact surface spreading around the circumference of the discharge opening and being brought into contact with the object, a discharge hole formed in the main body of the application nozzle, the discharge hole extending from the discharge opening toward the inside of the application nozzle and guiding the discharge of the fluid from the inside of the application nozzle, a corner face formed along the circumference of the discharge opening and chamfering a boundary between an inner wall of the discharge hole and the contact surface into a curved surface, and a coating layer formed on a surface of the application nozzle and covering an area extending from the contact surface including the corner face to the inner wall of the discharge hole.

According to the application device as an independent invention as describe above, durability of the application nozzle is dramatically improved, and an opening area of the discharge opening is kept fixed for a long time, which enables the stable application of the fluid throughout long applying operation. Therefore, for example, in the cigarette manufacturing machine or the like, even if the flow rate of application of the fluid seam paste is increased with the speedup of the operation of the machine, it is possible to consistently manufacture cigarette products of constant quality.

Both of the coating layers in the above-mentioned two cases can be formed by diamond electrodeposition coating. In this case, a material of the application nozzle or a surface thereof is securely protected by being boned with diamond abrasive grains. Especially the coating layer formed by the diamond electrodeposition coating is excellent in its credibility since the bonding of the coating layer and the material of the nozzle can be securely obtained.

The aforementioned application nozzle has a polished surface on an inner wall of a passage communicated with the discharge hole, thereby reducing flow resistance of the fluid in the application nozzle. If the polished surface is formed on the inner wall of the application nozzle in this manner, the fluid is smoothly discharged, so that it is possible to fully carry out an original function of the application nozzle with the improvement in durability.

BEST MODE OF CARRYING OUT THE INVENTION

Hereinafter, a specific embodiment of the present invention for a cigarette manufacturing machine will be explained.

Figure 1:
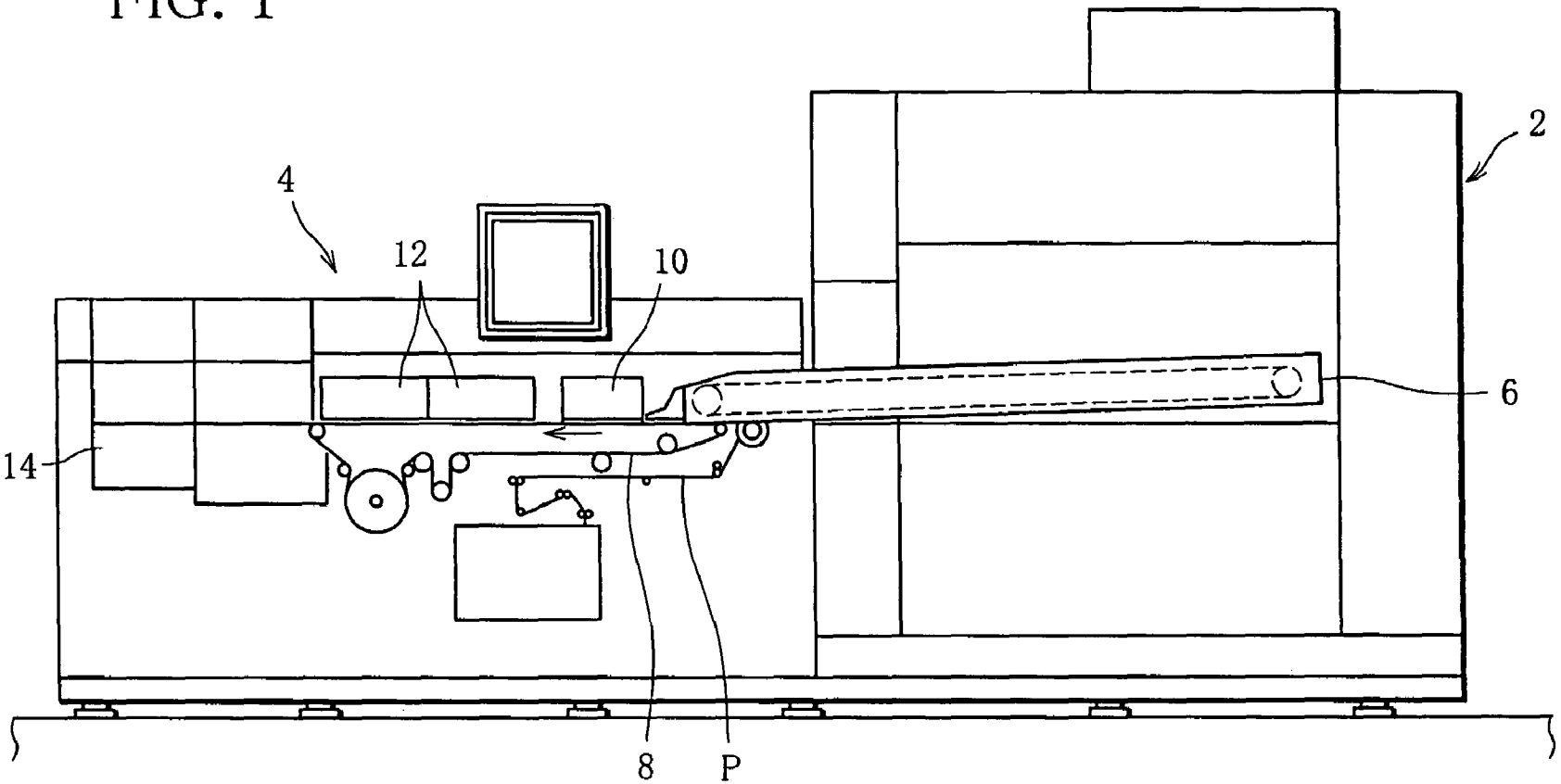
FIG. 1 is an elevation view of a cigarette manufacturing machine.

As illustrated in FIG. 1, the cigarette manufacturing machine comprises a feeding device 2 and a rod-forming device 4. As publicly known, the feeding device 2 has a suction conveyer 6. By the suction conveyer 6, shredded tobacco is formed in a layer and supplied to the rod-forming device 4. The rod-forming device 4 causes a cigarette wrapping paper P, together with endless garniture tape 8, to travel and receives the shredded tobacco layer thereon. That is, the shredded tobacco layer is transferred from a terminal end of the suction conveyer 6 on the wrapping paper P. Then, the shredded tobacco layer travels with the wrapping paper P and is compression-molded into a cylindrical rod with molds (tongue). The wrapping paper P is first bent into the shape of a U around the shredded tobacco layer in the process of travelling through a rod-forming section 10, and seam paste is applied to the left edge portion of the wrapping paper P with respect to the travelling direction thereof. While travelling, the wrapping paper P is further bent into a cylindrical form to wrap the shredded tobacco layer therein. The wrapping of the wrapping paper P causes the left edge portion thereof to be superimposed on the right edge portion, and these edge portions are bonded to each other with the seam paste. Moreover, the seam paste is dried in the next drying section 12, thereby continuously forming a tobacco rod. Then, the tobacco rod is cut into cigarette rods of double length of a single cigarette in a cutting section 14, and the cigarette rods of double length are supplied from the cigarette manufacturing machine to a filter attachment, not shown.

Figure 2:
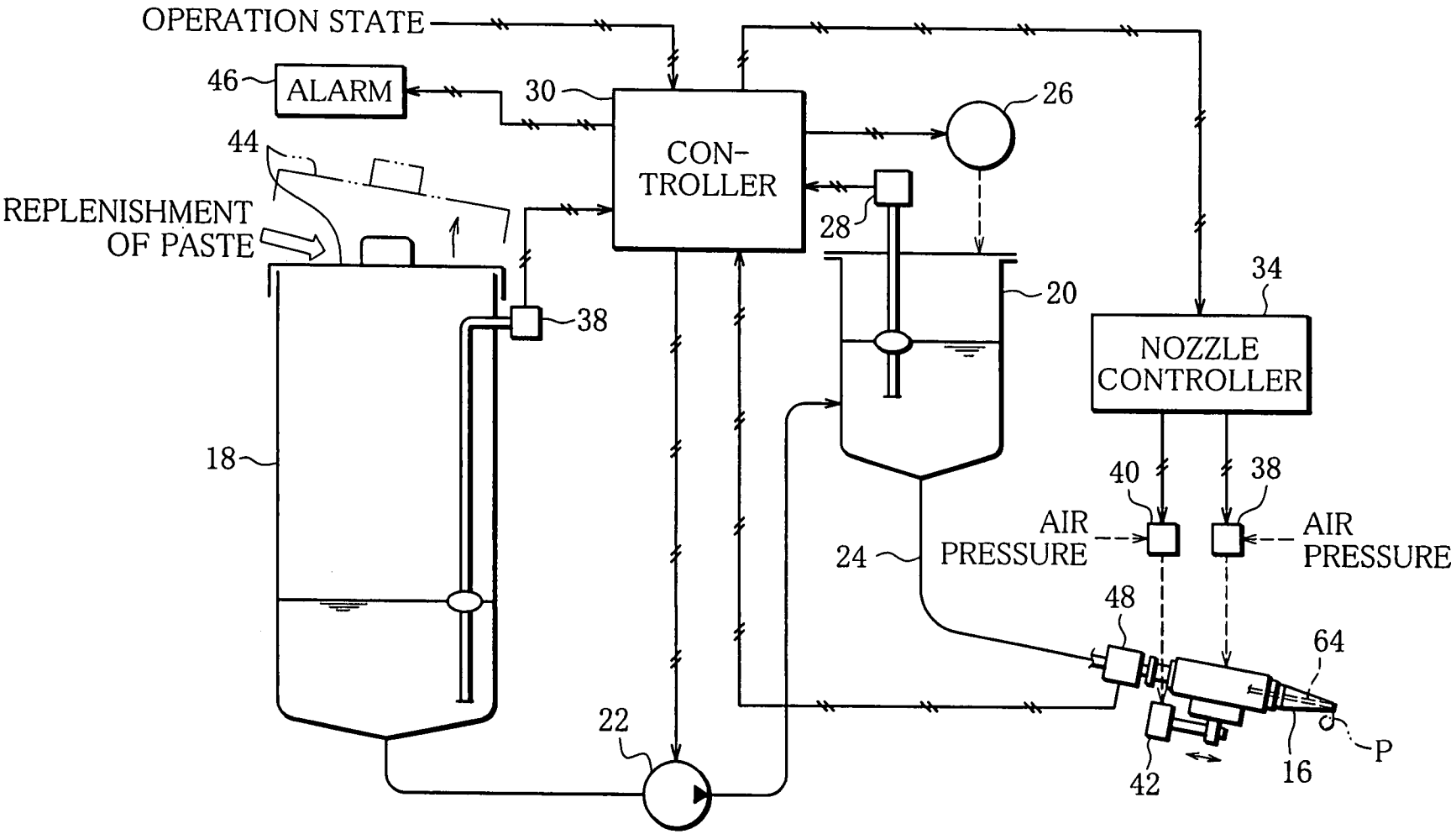
FIG. 2 is a schematic view showing a structure of an application device according to an embodiment.

FIG. 2 schematically shows an application device. The application device comprises an application nozzle 16 located in the rod-forming section 10 of the cigarette manufacturing machine so that a discharge opening thereof is directed to face the left edge portion of the wrapping paper P. The seam paste to be applied to the wrapping paper P from the application nozzle 16 is stored in a reservoir tank 18 of large size. The reservoir tank 18 is provided as a separate member apart from the cigarette manufacturing machine and, for example, located in the rear side of the frame of the machine. On the other hand, the frame of the cigarette manufacturing machine is equipped with a pressure tank 20 of small size, and the pressure tank 20 is connected to the reservoir tank 18 through a pipe. A feed pump 22 is interposed in the pipe line and feeds the seam paste in the reservoir tank 18 toward the pressure tank 20, thereby supplying the seam paste to the pressure tank 20.

The pressure tank 20 has a bottom formed into the shape of a funnel, and an outlet thereof is connected to the application nozzle 16 through a supply pipe 24. The seam paste in the pressure tank 20 can be supplied through the supply pipe 24 to the application nozzle 16.

The inside of the pressure tank 20 has a structure for sealing the inside thereof, and air pressure is supplied from a pneumatic unit 26 to the sealed space of the pressure tank 20. A regulator valve, not shown, is interposed in a supply path of the air pressure, thereby maintaining the inside of the pressure tank 20 under a constant air pressure that is more pressurized than outer atmospheric pressure.

Furthermore, the pressure tank 20 is provided with a level sensor 28. The level sensor 28 detects fluid level of the stored seam paste in the pressure tank 20 and outputs a detection signal to a controller 30. The controller 30 has a control function for maintaining the fluid level of the stored seam paste in the pressure tank 20 and is capable of controlling operation of the feed pump 22 to retain a target fluid level according to a control program for the control function. Specifically, the controller 30 receives the detection signal from the level sensor 28 as feedback signal and brings the feed pump 22 into operation to control a supply amount of the seam paste for the purpose of adjusting an actual fluid level to a target value.

The application nozzle 16 has a discharge opening that is openable and closable by a needle valve 64, and the needle valve 64 can be activated, for example, through the air pressure. The controller 30 is further connected to a nozzle controller 34 that controls forward/backward movement of the application nozzle 16 in addition to opening/closing operation of the needle valve 64. Specifically, the nozzle controller 34 is connected with a pneumatic valve 38 for activating the needle valve 64 and a pneumatic valve 40 for moving forward or backward the application nozzle 16. The pneumatic valves 38 and 40 operate by operation signals from the nozzle controller 34. The forward/backward movement of the application nozzle 16 can be realized, for example, by means of an air cylinder 42, and the air cylinder 42 is connected to the pneumatic valve 40.

After the operation of the cigarette manufacturing machine is started, when a condition that allows the application of the seam paste to be performed is fulfilled, the controller 30 sends a response signal to the nozzle controller 34. When receiving this response signal, the nozzle controller 34 activates the pneumatic valve 40 and extends a piston rod of the air cylinder 42 to cause the application nozzle 16 to advance toward the wrapping paper P. Thus, the discharge opening of the application nozzle 16 is pressed against the left edge portion of the wrapping paper P. On the contrary, in a condition that does not allow the application of the seam paste to be performed, the controller 30 sends a response signal to the nozzle controller 34. When the response signal is received to the nozzle controller 34, the nozzle controller 34 retracts the piston rod of the air cylinder 42 to cause the application nozzle 16 to retreat from the wrapping paper P.

When the wrapping paper P is supplied, and a condition that allows the application of the seam paste to be performed is fulfilled, the controller 30 transmits a response signal to the nozzle controller 34. When receiving the response signal, the nozzle controller 34 activates the pneumatic valve 38 and opens the needle valve 64 of the application nozzle 16. On the contrary, if a condition that does not allow the application of the seam paste to be performed is fulfilled due to abeyance of the cigarette manufacturing machine or the like, a response signal is transmitted from the controller 30 to the nozzle controller 34. In this case, the nozzle controller 34 closes the needle valve 64.

During the operation of the cigarette manufacturing machine, an encoder pulse is output from an encoder (not shown) disposed on the frame of the machine, and the pulse is input into the controller 30 as operation state signal. As described above, the controller 30 sends various signals to the nozzle controller 34 according to the operation state of the cigarette manufacturing machine and the like. The nozzle controller 34 brings the application nozzle 16 to advance or retreat, and opens or closes the needle valve 64 according to these signals.

Moreover, the seam paste is stored in the pressure tank 20 to the target fluid level, and prescribed air pressure is applied to the inside of the pressure tank 20. Therefore, the supply pressure of the seam paste from the pressure tank 20 to the application nozzle 16 is determined, based on the air pressure applied to the inside of the pressure tank 20. Pressure loss caused by friction of the seam paste in the supply pipe 24 and the application nozzle 16 is structurally constant, so that such a loss does not affect pulsation of the supply pressure of the seam paste. Moreover, the air pressure to be applied to the inside of the pressure tank 20 can be suitably adjusted so that a desired discharge quantity may be obtained according to operation speed of the cigarette manufacturing machine and an amount of the seam paste to be applied.

On the other hand, during the operation of the cigarette manufacturing machine, the controller 30 adjusts the supply amount of the seam paste from the reservoir tank 18 to the pressure tank 20 and performs control for maintaining the fluid level of the stored seam paste in the pressure tank 20 at a fixed level as described above. Therefore, the supply pressure of the seam paste to the application nozzle 16 is stabilized throughout the operation of the cigarette manufacturing machine, which makes it possible to apply a fixed quantity of the seam paste to the wrapping paper P.

When the residual amount of the seam paste in the reservoir tank 18 is reduced, the controller 30 activates an alarm 46 to give an alarm about the deficiency of the residual amount based on the detection signal transmitted from the level sensor 38 and urges an operator to resupply the seam paste. Unlike the pressure tank 20, the reservoir tank 18 is a container of an air-open type and thus has a structure capable of resupplying the seam paste by opening a lid 44 thereof as shown in FIG. 2 whether or not the cigarette manufacturing machine is in operation.

For example, in a case that the operation of the cigarette manufacturing machine is abruptly stopped, the controller 30 sends a response signal to the nozzle controller 34, and then the nozzle controller 34 closes the needle valve 64. Consequently, the discharge of the seam paste from the application nozzle 16 is immediately discontinued.

As illustrated in FIG. 2, a pressure sensor 48 is inserted in the supply pipe 24 at a position in the vicinity of an inlet of the application nozzle 16. The pressure sensor 48 has a digital display (not shown), and the display is visible from the operator. The pressure sensor 48 detects the pressure of the seam paste supplied to the application nozzle 16 and outputs a detection signal to the controller 30. In addition, the pressure sensor 48 has a function of digital-displaying a detection value in the display thereof. The operator can monitor discharge pressure of the seam paste from the application nozzle 16 any time by reading the numeric value on the display. Therefore, in a case that the discharge pressure is greatly changed, it is obvious that the supply amount of the seam paste is also changed. In this case, the operator can stop the operation of the machine and perform calibration of the supply amount of the paste.

The controller 30 has a function of activating the alarm 46 based on the detection signal output from the pressure sensor 48. Specifically, an upper limit within a generally allowable range with respect to the supply pressure of the seam paste is previously stored in the controller 30. When the supply pressure detected by the pressure sensor 48 reaches the upper limit or more, the controller 30 activates the alarm device 46 to give an alarm indicative of a pressure error. Such a pressure error may be caused, for example, in a case that paste sullage (solid matter, impurities, etc.) clogs up the application nozzle 16 even if the fluid level in the pressure tank 20 is constant. In this case, the operator realizes from the alarm that there occurs some paste-clogging or the like in the application nozzle 16 and can take action in cleaning, inspection or the like with respect to the application nozzle 16.

In the application device according to the above embodiment, the supply pressure of the seam paste is constantly stable, so that the application amount to the wrapping paper P does not fluctuate even if high-speed operation of the cigarette manufacturing machine is performed. Furthermore, since the seam paste is smoothly discharged from the application nozzle 16, the application device is suitable to the case that the high-speed operation of the machine is carried out with a small application amount of the seam paste.

In the above embodiment, size and location of the reservoir tank 18 and pressure tank 20 may be properly changed, which makes it possible to design an optimum layout according to specification of the cigarette manufacturing machine. Moreover, in the control of the controller 30 over the fluid level of the stored seam paste, target value for the fluid level may be provided beforehand, and the target value may be temporally changed, based on determination of suitability of actual application amount of the seam paste from the application nozzle 16.

The alarm 46 may be designed to produce, for example, a warning sound, a voice-warning message or the like, and alternatively, may be designed to flash a warning light, indicate a warning message on the display, or provide a combination of these.

Next, technical features of the application nozzle 16 will be explained. The technical features described latter may be included in the structure shown in FIG. 1. Alternatively, the application nozzle 16 includes an independent invention by itself in consideration of the following technical features thereof.

Figure 3:
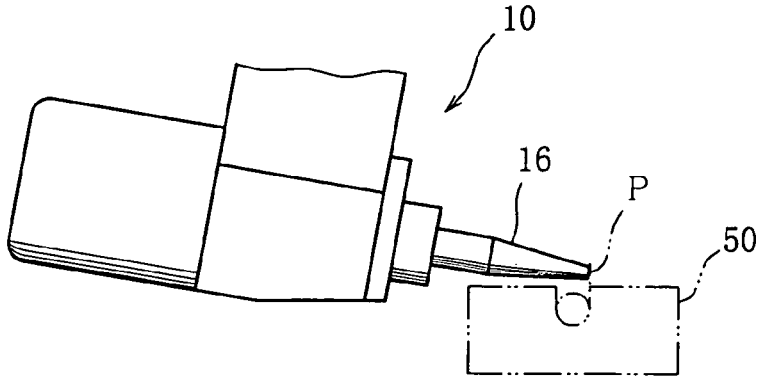
FIG. 3 is a schematic view showing an application nozzle.

FIG. 3 schematically shows the application nozzle 16. As already mentioned, the application nozzle 16 is so disposed that a tip end thereof is directed to face the left edge portion of the wrapping paper P in the rod-forming section 10 of the cigarette manufacturing machine. At this point, the wrapping paper P, together with the garniture tape 8, is bent by a forming bed 50 of the section 10, and the left edge portion thereof is upstanding almost perpendicularly to the forming bed 50. In addition, the right edge portion of the wrapping paper P is bent by an upper forming guide (short holder), not shown, to wrap a shred tobacco layer.

Figure 4:
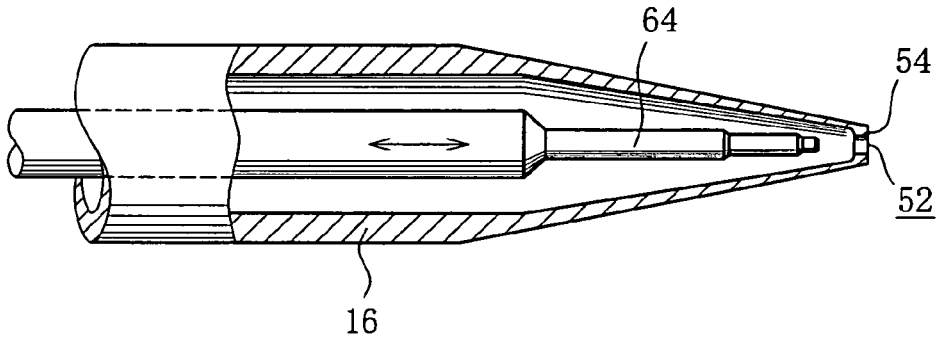
FIG. 4 is a detail view of the application nozzle.
Figure 5:
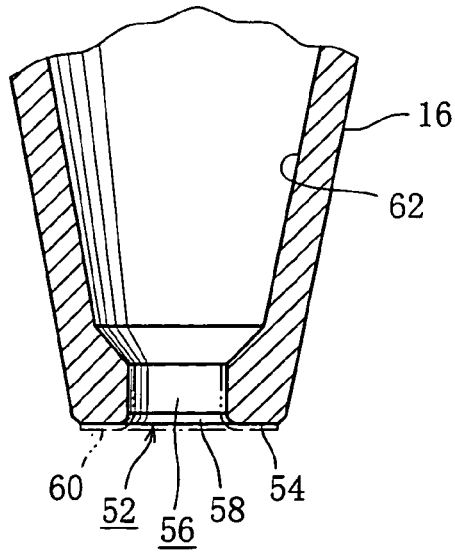
FIG. 5 is an enlarged view of a tip end portion of the application nozzle.

FIG. 4 illustrates the structure of the application nozzle 16 in detail, while FIG. 5 is an enlarged view of the tip end portion of the application nozzle 16. The application nozzle 16 has a cylindrical main body, and the tip end portion extending from the main body is formed into a truncated hollow cone. Formed at the tip end of the application nozzle 16 is an open discharge opening 52, and the application nozzle 16 can apply the seam paste to the wrapping paper P by running off the seam paste from the discharge opening 52. Moreover, a contact surface 54 spreading around circumference of the discharge opening 52 is formed on the tip end of the application nozzle 16, namely a top face of the truncated cone, and the application nozzle 16 is brought into contact with the left edge portion of the wrapping paper P on the contact surface 54 of the nozzle 16.

The tip end of the application nozzle 16 has a given thickness, and there is formed in the tip end a discharge hole 56 extending from the discharge opening 52 toward the inside of the nozzle 16. The discharge hole 56 is formed into a circle in section and guides outflow of the seam paste from the inside of the application nozzle 16 to the discharge opening 52.

A corner face 58 is formed along the circumference of the discharge opening 52. The corner face 58 is obtained by R-processing an edge of the discharge opening 52, and the boundary between the inner wall of the discharge hole 56 and the contact surface 54 is chamfered into a curved surface or the corner face 58. Additionally, a radius of the R-processed portion is preferably about 0.3 mm, for example.

A material of the application nozzle 16 is made of stainless steel, for example, and a surface thereof is provided with a coating layer 60 covering a portion from the contact surface 54 of the tip end to the inner wall of the discharge hole 56. The coating layer 60 is formed by diamond electrodeposition coating, and the material is subjected to hardening as preprocessing. The diamond electrodeposition coating embeds diamond abrasive grains in the surface of the material through an electroplating method (electrolysis Ni method), and this processing technology is widely used for tools, members and the like required to have abrasion resistance. Moreover, the coating layer 60 may be formed by the electrodeposition coating of CBN (cubic boron nitride) abrasive grains instead of diamond abrasive grains. In the case of this embodiment, the coating layer 60 has a thickness of 2 to 6 μm, for example.

As shown in FIG. 5, the application nozzle 16 has an inner wall 62. The inner wall 62 tapers toward the tip end thereof and is subjected to polishing as finish. The surface roughness of the inner wall 62 has a surface roughness of a polished surface. The inner wall 62 of the application nozzle 16 has an inner diameter. The inner diameter is maintained up to the tip end as large as possible, and is formed so that only the discharge hole 56 is narrowed at the tip end. As illustrated in FIG. 4, the application nozzle 16 has a valve needle 64 inside. The valve needle 64 is formed to have a stepped shape in an axial direction, and an external diameter thereof is decreased in stages toward the tip end in accordance with the shape of the inner wall 62 of the application nozzle 16.

During the operation of the cigarette manufacturing machine, when the seam paste is supplied from the pressure tank 20 to the application nozzle 16, the main body of the application nozzle 16 is filled with the seam paste by the supply pressure. Once the valve needle 64 is opened, the seam paste flows through the discharge hole 56 and runs out from the discharge opening 52 at the tip end so that the seam paste is applied to the wrapping paper P. At this moment, the seam paste causes a great fluid friction against the inner wall of the discharge hole 56 and the circumference of the discharge opening 52. However, the material of the application nozzle 16 is covered with the coating layer 60, thereby being protected from the fluid friction caused by seam paste.

Therefore, even if the main body of the application nozzle 16 receives a strong fluid friction for a long time with the speedup of operation of the cigarette manufacturing machine, the material of the discharge opening 52 and discharge hole 56 located at the tip end of the application nozzle 16 is hardly corroded, which considerably improves durability of the application nozzle 16.

In the coating layer 60, a region extending from the contact surface 54 to the inner wall of the discharge hole 56 is smoothly connected to each other through the corner face 58 therebetween, and there is no edge interposed the region, so that a fixed thickness of the coating layer 60 can be secured throughout the region. Since the circumference of the discharge opening 52 is formed into the curved surface or the corner face 58, no edge is formed on the circumference of the discharge opening 52. Thus, intensive corrosion does not occur in the material of the circumference of the discharge opening 52.

The valve needle 64 is opened/closed according to the operation state of the cigarette manufacturing machine or the like. Once the operation of the machine is stopped, the valve needle 64 immediately closes the discharge hole 56; on the contrary, when the operation is commenced, the valve needle 64 opens the discharge hole 56 instantly. When the valve needle 64 is opened, the application nozzle 16 shows an excellent discharge response since flow resistance of the seam paste is reduced due to the shape of the application nozzle 16 and the surface finish (polished surface) of the inner wall 62 as described above.

Although the above embodiment provides an example of preferable material and shape for the application nozzle 16, in a case that the present invention is applied to a cigarette manufacturing machine, the application nozzle 16 may be suitably changed in its material, shape, specification and the like in accordance with the type and the operation speed of the machine, and the outflow, physical property and the like of the seam paste to be used. Furthermore, the present invention may be applied to not only the method in which an object is caused to travel but also the one in which an application nozzle is moved to apply fluid to an object.

In addition, the present invention may be utilized not only for the cigarette manufacturing machine but also for the use of applying lap paste, rail paste or the like in a filter manufacturing machine, or applying aroma chemical, and may be employed in wide use as a fluid application device.

REFERENCE MARKS

2 feeding device
4 rod-forming device
6 suction conveyer
8 garniture tape
10 rod forming section
12 drying section
14 cutting section
16 application nozzle
18 reservoir tank (first tank)
20 pressure tank (second tank)
22 feed pump (feeding means)
24 supply pipe (supply path)
26 pneumatic unit (pressurizing means)
28 level sensor (fluid level-detecting means)
30 controller (maintaining means)
34 nozzle controller (opening/closing means)
38 air pressure valve
40 air pressure valve
42 air cylinder
44 lid
46 alarm
48 pressure sensor (pressure-detecting means)
50 forming bed
52 discharge opening

54 contact surface
56 discharge hole
58 corner face
60 coating layer
62 inner wall
64 valve needle
P wrapping paper (object)

The invention claimed is:

1. A fluid application device comprising:

an application nozzle including a discharge opening directed to face an object that relatively travels with respect to the application device, said application nozzle discharging liquid fluid from the discharge opening and applying the fluid to the object;

a first tank storing the fluid to be applied to the object;

a second tank connected to said first tank;

feeding means for feeding the fluid from said first tank and supplying the fluid toward said second tank;

a supply path for connecting said second tank to said application nozzle and allowing the fluid in said second tank to be supplied to said application nozzle;

pressurizing means for sealing an inside of said second tank and applying a prescribed air pressure to the sealed inside of said second tank;

fluid level-detecting means for detecting a fluid level of the fluid in said second tank; and maintaining means for controlling a fluid supply performed by said feeding means based on a detection result of said fluid level-detecting means and maintaining the fluid level at a fixed level, wherein said application nozzle further includes:

a main body having a tip end with the discharge opening, and a passage defined inside the main body and tapered toward the discharge opening;

a valve needle arranged in the main body, for opening and closing the discharge opening, the valve needle having a stepped shape of which the diameter decreases in stages toward the discharge opening and which corresponds in position to the passage;

a contact surface formed on the tip end of the main body, the contact surface spreading around a circumference of the discharge opening and being brought into contact with the object;

a discharge hole extending from the discharge opening toward inside of the main body and guiding flow of the fluid from the inside of the main body;

a corner face formed along the circumference of the discharge opening and chamfering a boundary between an inner wall of the discharge hole and the contact surface into a curved surface; and a coating layer formed on a surface of the main body and covering a region from the contact surface including a corner face to the inner wall of the discharge hole.

2. The fluid application device according to claim 1, wherein an inside of said first tank is open to the atmosphere.

3. The fluid application device according to claim 1, further comprising:

pressure-detecting means for detecting a pressure of the fluid supplied to the application nozzle through said supply path; and alarm means for giving a prescribed alarm when the pressure detected by said pressure-detecting means is at a given or higher value.

4. The fluid application device according to claim 3, wherein said pressure-detecting means includes a pressure indicator that indicates a detection value.

5. The fluid application device according to claim 1, wherein said application nozzle is disposed in a rod-forming section of a cigarette manufacturing machine, and seam paste is applied to one of side edge portions of wrapping paper when the wrapping paper travels through the rod-forming section together with garniture tape, the side edge portions of the wrapping paper forming a lap region thereof, the fluid application device further comprising:

opening/closing means for opening/closing said valve needle according to an operation state of the cigarette manufacturing machine.

6. The fluid application device according to claim 1, wherein the coating layer is formed by diamond electrodeposition coating.

7. The fluid application device according to claim 1, wherein the main body has a polished surface on an inner wall of a passage continuing to the discharge hole.

8. A fluid application device comprising:

an application nozzle directed to face an object that relatively travels with respect to said nozzle and being provided with a discharge opening formed at tip end thereof, for discharging fluid to continuously apply the fluid to the object;

a contact surface formed at the tip end of said application nozzle, said contact surface spreading around a circumference of the discharge opening and being brought into contact with the object;

a discharge hole formed in a main body of said application nozzle, said discharge hole extending from the discharge opening toward an inside of said application nozzle and guiding flow of the fluid from the inside of said application nozzle;

a corner face formed along the circumference of the discharge opening and chamfering a boundary between an inner wall of said discharge hole and said contact surface into a curved surface; and a coating layer formed on a surface of said application nozzle and covering a region from said contact surface including said corner face to the inner wall of said discharge hole, wherein the application nozzle further includes:

a main body having a tip end with the discharge opening, and a passage defined inside the main body and tapered toward the discharge opening; and a valve needle arranged in the main body, for opening and closing the discharge opening, the valve needle having a stepped shape of which the diameter decreases in stages toward the discharge opening and which corresponds in position to the passage.

9. The fluid application device according to claim 8, wherein said coating layer is formed by diamond electrodeposition coating.

10. The fluid application device according to claim 8, wherein said application nozzle has a polished surface on an inner wall of a passage connected to said discharge hole.

11. A fluid application device comprising:

an application nozzle including a discharge opening directed to face an object that relatively travels with respect to the application device, said application nozzle configured to discharge liquid fluid from the discharge opening and apply the fluid to the object;

a first tank configured to store the fluid to be applied to the object;

a second tank connected to the first tank;

a feed pump configured to feed the fluid from the first tank to the second tank;

a supply path connecting the second tank to the application nozzle and configured to allow the fluid in the second tank to be supplied to the application nozzle, wherein said application nozzle includes:

a main body having a tip end directed to face the object;

a contact surface formed on the tip end of the main body, the contact surface spreading around a circumference of the discharge opening and being brought into contact with the object;

a discharge hole extending from the discharge opening toward an inside of the main body and configured to guide a flow of the fluid from the inside of the main body; and a curved corner face formed along the circumference of the discharge opening and curving from an inner wall of the discharge hole towards an outside of the main body.

12. The fluid application device according to claim 11, wherein the application nozzle further includes:

a coating layer formed on a surface of the main body and covering a region from the contact surface including the corner face to the inner wall of the discharge hole.

13. The fluid application device according to claim 11, further comprising:

a pressure pump configured to seal an inside of the second tank and apply a prescribed air pressure to the sealed inside of said second tank;

a detector configured to detect a fluid level of the fluid in the second tank; and a controller configured to control a fluid supply performed by said feed pump based on a detection result of said detector and to maintain the fluid level at a fixed level.

14. The fluid application device according to claim 11, wherein an inside of said first tank is open to the atmosphere.

15. The fluid application device according to claim 11, further comprising:

a detector configured to detect a pressure of the fluid supplied to the application nozzle through said supply path; and an alarm configured to provide an alarm when the pressure detected by detector is at a given or higher value.

16. The fluid application device according to claim 15, wherein said detector includes a pressure indicator that indicates a visible detection value.

17. The fluid application device according to claim 11 wherein said application nozzle is disposed in a rod-forming section of a cigarette manufacturing machine, and seam paste is applied to one side edge portion of wrapping paper when the wrapping paper travels through the rod-forming section together with garniture tape, the side edge portions of the wrapping paper forming a lap region thereof, the fluid application device further comprising:

a valve needle configured to open and close a discharge opening of said application nozzle; and a nozzle controller configured to open and close the valve needle according to an operation state of the cigarette manufacturing machine.

18. The fluid application device according to claim 11, wherein the coating layer comprises a diamond electrodeposited coating layer.

19. The fluid application device according to claim 11, wherein the main body has a polished surface on an inner wall of a passage continuing to the discharge hole.

* * * * *